United States Patent [19]

Finn et al.

[11] Patent Number: 4,579,771

[45] Date of Patent: Apr. 1, 1986

[54] LAMINATED SPIRAL MESH PAPERMAKERS FABRIC

[75] Inventors: William A. Finn, Summersville, S.C.; Harry I. Searfass, Wayne, Pa.

[73] Assignee: Asten Group, Inc., Devon, Pa.

[21] Appl. No.: 752,911

[22] Filed: Jul. 8, 1985

Related U.S. Application Data

[63] Continuation-in-part of Ser. No. 639,959, Aug. 10, 1984, Pat. No. 4,528,236.

[51] Int. Cl.[4] ..... D03D 13/00

[52] U.S. Cl. ..... 428/222; 428/233

[58] Field of Search ..... 428/222, 233

[56] References Cited

U.S. PATENT DOCUMENTS 4,500,590 2/1985 Smith ..... 428/222

*Primary Examiner*—Marion C. McCamish

*Attorney, Agent, or Firm*—Benasutti and Murray

[57] ABSTRACT

The present invention relates to multilayer papermakers fabric having an upper layer comprised of an upper layer and an under layer comprised of a plurality of intermeshed monofilament spiral coils, retained by pintle means; the upper and lower layers having different permeabilities and being unified into a single fabric by application of adhesives to the interface between the upper layer and the under layer.

22 Claims, 7 Drawing Figures

LAMINATED SPIRAL MESH PAPERMAKERS FABRIC

This application is a continuation-in-part of our application Ser. No. 639,959, filed on Aug. 10, 1984 now U.S. Pat. No. 4,528,236, which is incorporated herein as if fully set forth.

BACKGROUND OF THE INVENTION

1. Field of the Invention

The disclosed fabric is intended for use in the papermaking industry and finds application in the forming, wet press and dryer section of the papermaking equipment. The fabric is a carrying or conveying means used in the production of paper and is intended for use in applications requiring either a circular woven or a flat woven fabric. In the papermaking industry, fabrics of the instant invention, when used in the wet press or dryer section, are frequently referred to as felts since they generally comprise a carrier fabric, which runs in contact with the equipment, and a felt surface, which runs in contact with the paper. Likewise, fabrics used in the forming section are frequently referred to as Fourdrinier wires or simply wires and the forming section of the papermaking process is frequently referred to as the Fourdrinier section or equipment.

It has been recognized in the prior art that it is desirable to provide a felt for use in papermaking machinery comprising an under layer made of relative rigid non-deformable material having a compressible felt layer thereon. The under layer is generally expected to provide a desired void volume for receiving and carrying off water removed from the paper sheet. For example, as the fabric with the paper sheet thereon passes between the nip rollers in the press section, the felt is compressed and water is transferred from the paper sheet to the felt. The water is intended to migrate through the felt and to be voided through the voids provided in the under layer.

The prior art, has recognized that a felted surface used in combination with an under layer having a predetermined and controlled void volume may be utilized to provide a felt having relatively fine fibers for contacting the sheet of paper to be processed. U.S. Pat. Nos. 3,613,258; 4,199,753; 4,283,454 and 4,356,225 are representative of prior art attempts to control void volume.

In the forming section it has also been recognized that a high void volume or permeability in the base fabric is highly desirable. However, due to the nature of the papermaking process it is essential that the forming wire or fabric retain the fibrous material in the slurry while permitting rapid drainage of the fluid. One prior art attempt to produce a laminated non-woven papermakers Fourdrinier wire is disclosed in U.S. Pat. No. 3,121,660.

2. Summary of the Invention

The present invention provides a papermakers fabric having an under layer, comprised of a plurality of intermeshed preformed spirals, defining a void volume and an upper fabric layer adhered thereto. The upper fabric may be adhered to the under layer by the selective application of adhesive to the under layer and/or to the upper layer or may be achieved by including meltable adhesive means within the upper layer. The under layer and the upper layer are unified into a single fabric, such as by the application of heat and pressure efficient to activate the adhesive, and form a single fabric as used in the papermaking equipment.

DESCRIPTION OF THE PREFERRED EMBODIMENTS(S)

Figure 1:
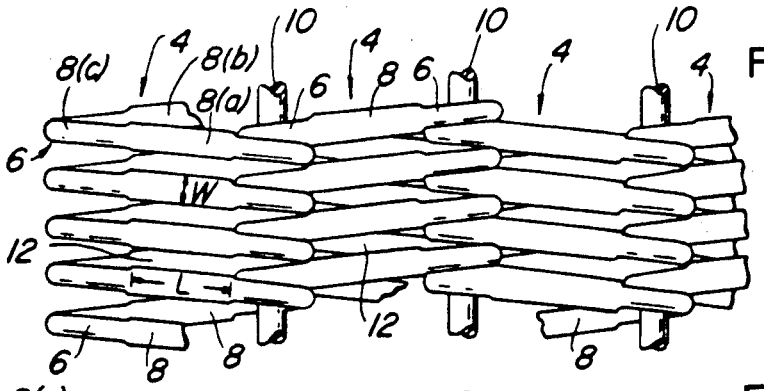
FIG. 1 is a top plan fragmentary view of an under layer of fabric showing a plurality of intermeshed spiral strips, each of the spirals having modified midsections.

With reference to FIG. 1, there is shown an under layer or base fabric generally referenced as 2. The under layer or base fabric 2 is comprised of a plurality of intermeshed spiral strips 4 which are retained in the intermeshed condition by a plurality of pintles 10. Each of the spiral strips 4 is a monofilament comprised of a plurality of spirals 6. Formation of spiral strips 4 will be discussed in more detail hereinafter. Each of the spirals 6 is comprised of an upper face 8(*a*), a lower face 8(*b*) and connecting links 8(*c*). In the embodiment shown in FIG. 1, upper face 8(*a*) and lower face 8(*b*) are modified and have a surface width greater than the connecting links 8(*c*). The modification of upper face 8(*a*) and lower face 8(*b*) result in a fabric having reduced void volume and/or permeability. Depending upon the degree of control desired, both the upper and lower face may be modified as shown in FIG. 1 or only a single face may be modified. If only a single face is to be modified, it is generally preferred to modify the upper face 8(*a*) as this is the portion of the fabric which will be closest to the paper supporting surface.

It will be appreciated that the monofilament of spiral strip 4 is rigid or incompressible and not easily deformed in the fabric.

With respect to formation of the spiral strips and the upper formation of upper and lower faces 8(*a*) and 8(*b*), which may be formed after the formation of the spiral strips, equipment for each of these purposes is available from EHVAK Maschinen GmbH, Niederroder Weg 10, 6056 Heusenstamm, West Germany.

In order to form the under layer or base fabric 2, the desired number of spiral strips 4 are positioned adjacent each other such that the link portion 8(*c*) of the spirals on one spiral strip are intermeshed with their counterparts on another spiral strip in order to form a pintle receiving passage. A pintle 10 is then inserted into the passage and retains the spiral strips 4 in the fabric construction. In general, the length of upper face 8(*a*) and lower face 8(*b*) will be controlled so as to permit the respective links 8(*c*) of the adjacent spiral strips to interlace without interference resulting from the modification of the monofilament. It will be appreciated that the permeability of the fabric in that portion where the links 8(*c*) are intermeshed and the pintle is located will generally be less than that for the remainder of the fabric. The degree of modification of the upper face and lower face will reflect considerations regarding the void volume and permeability in the intermeshed area of the fabric. As noted previously, in certain applications, it may be desirable to eliminate either one or both of the faces 8(*a*) and/or 8(*b*).

With reference to FIG. 1, it can be seen that an open mesh 12 is defined in the fabric between adjacent faces 8(*a*) and between the opposed links 8(*c*) of the respective spiral strips. As will be appreciated by those skilled in the art, a fabric having spiral strips with faces 8(*a*) and 8(*b*) will define similar open mesh areas on either face of the fabric. For those fabrics having only a single face 8(*a*) or 8(*b*) the open mesh 12 will be different on the respective faces of the fabric.

With reference to the permeability of the fabric 2, it will be appreciated by those skilled in the art that the desired permeability will vary with machine design and end use applications. However, it is estimated that the finished fabric will generally be between 40 CFM (cubic feet per minute) and 250 CFM for dryer fabric applications and between 10 CFM and 100 CFM for wet or press felt applications. Permeability for forming fabrics may be as high as 1000 CFM and will be discussed in more detail hereinafter. Those skilled in the art will further understand that the batt 24, FIG. 4 or fabric layer 40 of FIG. 6, will influence and contribute to the final permeability. In the United States testing is generally in accordance with ASTM D737-75 (reapproved 1980) on equipment such as the Frazier Air Permeability Tester, available from Frazier Precision Instrument Company, 210 Oakmont Avenue, Gaithersburg, Md. The ASTM standard entitled "Standard Test Method For Air Permeability of Textile Fabric" fully describes the test and its variations and is incorporated herein by reference as if fully set forth. However, such standards for air permeability are known throughout the world and the relative difference between and among the various fabrics is known to those skilled in the art.

Figure 2:
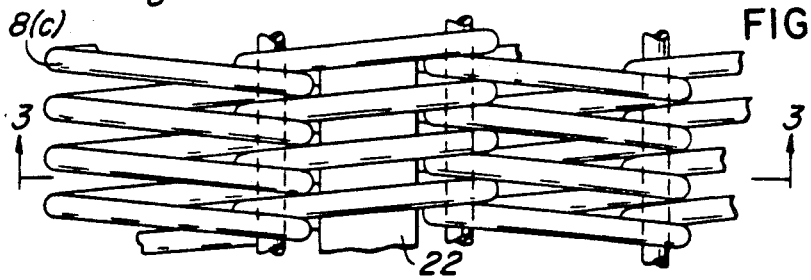
FIG. 2 is a top plan fragmentary view showing a plurality of intermeshed spiral strips, each of the spirals having a generally uniformed diameter throughout.

With reference to FIG. 2, there is shown a fabric 2 which is constructed in the same fashion as the fabric of FIG. 1. However, in the fabric of FIG. 2, the monofilament yarns do not have upper faces or lower faces such as 8(*a*) and 8(*b*) as shown in FIG. 1. Instead, each of the spirals 6 comprising the spiral strip 4 will be made up of monofilaments having a substantially uniformed diameter as represented by 8(*c*). It will be appreciated, that the void volume and permeability in the area of the intermeshed coils with pintle 10 will be lessened as in accordance with the description of FIG. 1. If modification of the void volume and/or permeability of fabric constructed according to FIG. 2 is desired, it may be accomplished by the use of filler strands, generally indicated at 22. The use of such filler strands and the various techniques for varying the permeability by insertion of filler strands will be known to those skilled in the art and does not require further explanation herein. Filler strands 22 may be of special usefulness in fabrics produced with shaped monofilaments as spirals 6 for the reasons noted below.

It will further be understood by those skilled in the art that the spirals 6 may be formed from shaped monofilaments.

Figure 3:
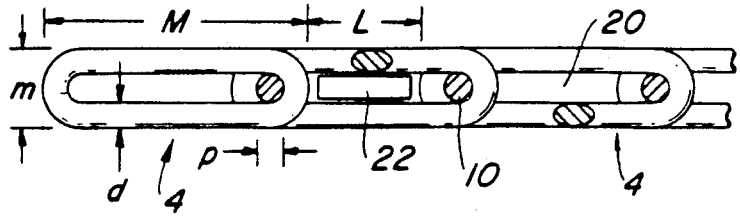
FIG. 3 is a section taken through the line 3—3 of FIG. 2 and depicts a side elevational view of the fabric of FIG. 2.

With reference to FIG. 3, there is illustrated a section view of the fabric according to FIG. 2. The spirals 6 have a major axis M and a minor axis m and a diameter d. FIG. 3 graphically depicts the intermeshing of the links 8(*c*) of adjacent spiral strips 4 and the location of the pintle 10. FIG. 3 clearly shows the reduced void volume or permeability of the intermeshed pintle area and likewise depicts the voids 20 which may be modified by means of filler strands 22 to control the void volume and/or permeability.

Further with reference to FIGS. 1, 2, and 3, it will be appreciated by those skilled in the art that the void volume and permeability of the fabric may be modified by various combinations of open mesh 12 and modified void volumes 20.

Figure 4:
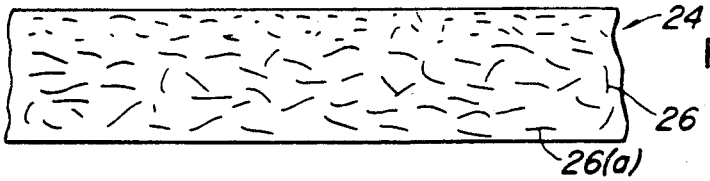
FIG. 4 is illustrative of a felt batt which may be applied to the fabric of FIGS. 1 and 2 in accordance with the invention.

With respect to FIG. 4, there is shown a felt batt 24. Batt 24, as will be known to those skilled in the art, may be made of different materials and various densities according to end product application. The batt 24 is generally firm and supports the paper being transported on the felt, however, batt 24 is more compressible than the under layer 2. The technique for forming the batt 24 will be known to those skilled in the art.

Figure 5:
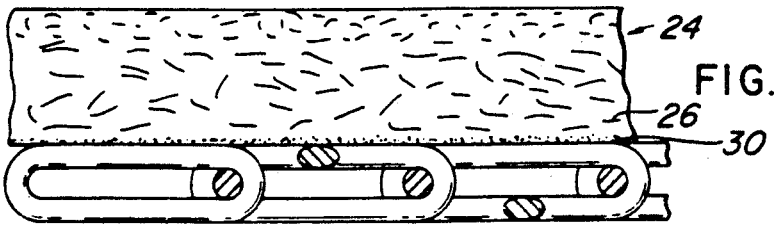
FIG. 5 is an illustrative drawing showing the completed fabric as produced by assembling the under layer of FIG. 3 with the felt of FIG. 4.

With respect to FIG. 5, there is illustrated a fabric, similar to that depicted in FIG. 2 with the batt, similar to that of FIG. 4 adhered thereto. In the embodiment depicted in FIG. 5, the batt 24 is adhered to the under layer or base fabric 2 by means of selective application of an adhesive layer 30 to the under layer or base fabric. The application of the adhesive 30 to under layer 2 may be made uniformly or by random application of the adhesive. Examples of adhesives suitable for application in the instant invention are Scotch Grip, an Epoxy available from 3M Company, Esthane, a urethane available from B. F. Goodrich and RTV Series Silicones, available from General Electric. As a result of adhesive layer 30, the under layer 2 and the batt 24 are maintained as an unitary fabric. It will be appreciated that the adhesive of layer 30 has been exaggerated for the purpose of illustration. It is anticipated that the adhesive layer will not occupy a major volume of the final fabric.

It is further to be appreciated that the adhesive must be applied with such care as to prevent adhesion of the spirals 6 and/or the adhesion of spiral strips 4. To obtain the full advantages of the invention the under layer or base fabric 2 must retain its flex characteristics within the finished felt. Excessive adhesion of spiral strips 4 may lead to under desired running characteristics and performance qualities.

In an alternative method of adhering the layers, the joining layer 18 may be comprised of heat meltable or fusible fibers which are incorporated into the fibers of batt 24 at the time it is fabricated. The use of heat meltable or fusible fibers in the batt 24 is depicted in FIG. 4 as 26(*a*). Incorporation of the fibers 26(*a*) may be achieved by a technique known to those skilled in the art as stratification. Additionally, the adhesive layer 30 could comprise a sprayed adhesive or a fusible film or a laminated layer which is applied to the under layer fabric 2. Suitable films may be formed of fusible polyethylenes, polypropylenes, polyamids, polyesters, and urethanes. Furthermore, it will be appreciated by those skilled in the art that the extent to which adhesive layer 30 extends over the surface of the fabric will depend upon the adhesive selected and the required adhesion.

As a further alternative, it is possible to adhere the fabrics by use of a resin treatment which is applied to the under layer fabric 2 to reduce its permeability. The use of a resin treatment to establish adhesion will be known to those skilled in the art.

With reference to FIGS. 1, 2 and 3, it will be appreciated that the diameter of the monofilament will affect the width of the faces 8, 8(*a*), and 8(*b*). Since it is desirable to have the links 8(*c*) in a touching or nearly touching relationship, the width, w, of the faces 8(*a*) and 8(*b*) is limited as a practical matter to twice the diameter, d, of the monofilament, thus $w=2d$. This condition when combined with the touching or near touching of the links 8(*c*) would, in effect, close off the space available between the individual spirals 6 and produce the maximum reduction in permeability. As the fabric is designed for greater permeability this relationship may be relaxed. With respect to the maximum length of the faces 8, 8(*a*), and 8(*b*), the length (L) may generally be expressed by the formula: maximum length (L) equals the major axis (M) minus twice the selected pintle diameter (p), plus four times the diameter of the monofilament (d) or $L=M-(2p+4d)$.

With respect to use of the invention in the forming area of the papermaking equipment, it will be noted that the under layer and the control of the permeability or drainage characteristics thereof will be in accordance with the above description related to FIGS. 1 through 3. As will be recognized by those skilled in the art, the economics of papermaking generally dictate that the fabrics used in the forming area will have maximum CFM or maximum drainage of fluids from the furnish which is applied to the fabric; likewise, it is desired to have maximum fiber retention in the forming area. As is known in the art, the ability to remove maximum fluid while retaining maximum fiber in the forming area results in reduced cost of drying the paper in subsequent sections of the papermaking equipment and also reduces the amount of fiber which is lost into the pans of the forming area and into the white water. It will also be recognized by those skilled in the art that virgin fiber will generally have a more controlled fiber length than may be present in reclaimed fiber. Likewise, those skilled in th art will recognize that the size of the interstices in the forming fabric must be selected in consideration of the fiber length contained in the furnish and the desired drainage and fiber retention characteristics of the fiber. It is understood by those skilled in the art that there is not a direct correlation between permeability and drainage. Depending upon weave construction and the number of layers in the fabric, it is possible to obtain the same drainage factor with fabrics having different permeabilities. This results from the method of testing air permeability which may be reduced by certain fabric constructions providing essentially the same void volume for drainage, but providing it in a more tortured path which results in reduced air permeability readings.

It is generally accepted that fiber retention in the area of 60 to 80 percent may be satisfactory for certain applications. Accordingly, fiber retention in excess of 80 percent is generally considered to be an improvement.

In view of the desire of those skilled in the art to obtain maximum drainage and fiber retention, it has been suggested to use duplex and triplex fabrics in the forming area, however, such fabrics are of a complex weave construction and are generally more expensive than those fabrics used in the prior art.

With respect to permeability of forming fabrics, it will be recognized by those skilled in the art that the permeability of the forming fabric may vary substantially in accordance with the application of the fabric. In single layer forming fabrics, permeabilities in the range of 600 to 800 CFM. For tissue paper applications, it is common to have fabrics with a CFM in the range of 700 to 800 and for fine papers it is common to have CFM in the range of 600 to 650. For certain non-paper applications, such as paper board, the CFM may range up to 1000. For two layer fabrics intended for fine papermaking, fabrics as low as 200 CFM has been reported with acceptable drainage characteristics. As can be seen from the foregone, the CFM may range up to approximately 1000 CFM, depending on the application. Likewise, it will be remembered that the size of the fabric interstices, drainage and the desired fiber retention will be dictated by the end use of the fabric and the cost of the fiber as well as the fiber length.

In forming fabrics according to the invention, the under layer or base layer of the fabric is utilized primarily to define the drainage characteristics and the upper layer is used primarily to define the percentage of fiber retention. Additionally, the upper layer will be primarily responsible for establishing the desired surface characteristics for contact with the paper web and the under layer will be primarily responsible for establishing the necessary mechanical strength for running the fabric on the papermaking equipment.

With prior art single layer fabrics, it is common to have open areas in the range of 16 to 48 percent of the total fabric area. For tissue paper applications percent open area in the range of 18 to 25 percent is common and for fine papers open areas of 19 to 35 percent are common. In some applications open area may range as low as about 10 percent and as high as about 50 percent of open area. It will be understood by those skilled in the art that open area generally refers to through apertures or interstices in the final fabric. Thus, if one were to hold the fabric up to a light source, light would shine through the open areas. In some of the duplex and triplex fabrics currently in use there is no open area in this traditional sense. However, drainage is achieved through the indirect paths referred to previously hereinabove. As used hereinafter open area refers to each fabric layer and not to the unitized fabric.

Figure 6:
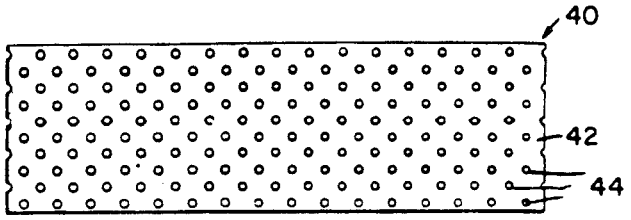
FIG. 6 is an illustrative drawing showing a non-woven upper layer which may be applied to the fabrics of FIGS. 1 and 2.

With reference to FIG. 6, there is shown a nonwoven upper layer for use in a fabric according to the invention. The upper layer 40 of FIG. 6 may be a sheet material molded of a number of plastic or synthetic materials such as polypropylene, polyester, teflon or other suitable materials. A sheat of material 42 is provided with a plurality of apertures 44 which may be cut or punched into the material 42. The size and location of the apertures 44 as well as the number will be determined by the end use. Generally, the opening or interstice of the aperture 44 will be determined by the fiber size in the furnish and the degree of retention desired. Likewise, the number or amount of apertures 44 which are provided in the material will be determined by the percentage open area desired in the final fabric layer. Accordingly, the desired open area will be influenced by the size of the apertures 44, which as noted before will be influenced by the fiber length in the furnish.

It wil be understood by those skilled in the art, that a woven fabric of any construction may be substituted for the upper layer 40 depicted in FIG. 6. For example, a fine woven fabric utilizing weaves known in the art, such as plain, twill, satin, broken satin, atlas and non-twill weaves may be used. Likewise, the number of sheds utilized in producing the upper layer weaves will be determined by the type of paper being produced. As is known by those skilled in the art, it is frequently desired to limit the amount of wire marking which takes place in the forming section and planar fabrics are generally preferred for this purpose. However, if one did wish to achieve wire marking in the paper for design purposes and the like, the upper layer could be woven to achieve such wire marking. Likewise, it will be understood that designs or patterns may be produced on non-woven upper layers as depicted in FIG. 6.

With respect to the upper layer, the essential criteria is to establish the desired fiber retention. The upper layer of the fabric need not exhibit a high degree of mechanical strength, since the under layer fabric will be substantially responsible for providing the mechanical strength necessary to permit the fabric to run on the papermaking equipment. The only criteria with respect to strength in the upper layer is that the upper layer exhibits sufficient strenght to permit its adhesion to the base layer during the uniting process and sufficient strength to resist damage from the furnish.

Figure 7:
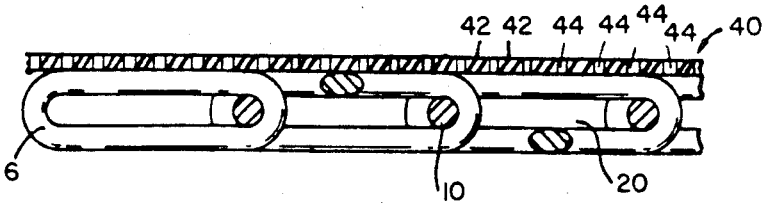
FIG. 7 is an illustrative drawing showing the non-woven upper layer of FIG. 6 as applied to the under layer of FIG. 3.

With respect to FIG. 7, there is illustrated a non-woven upper layer as depicted in FIG. 6 adhered to a base layer in accordance with the invention. The upper layer 40 has been exaggerated in size for the purpose of illustration and it will be recognized that the thickness of the upper layer 40 will only be determined by the required strength characteristics of the material selected and that the thickness thereof does not form any part of this invention. As can be seen, the apertures 44 will permit drainage of the water from the furnish while the solid portion 42 of the upper layer will retain the fiber. Likewise, it can be seen that open area in the upper layer need not align with the open area in the under layer.

With reference to FIG. 7, the spirals 6 of the under layer are in accordance with the description hereinabove and the under layer may have drainage, permeability and open area characteristics different than the upper layer. In the instant application it is preferred that the under layer have maximum drainage to permit rapid drainage.

With respect to the application of a woven fabric to the under layer, this may be accomplished in the same manner as depicted in FIG. 7. It will be understood by those skilled in the art that the interstices of a woven fabric will correspond to the apertures 44 and that the yarns which form the fabric will correspond to the solid portions 42.

With respect to the dryer position of the papermaking equipment, it will be recognized that the fabric depicted in FIG. 7 will be suitable for use at that position. By providing an upper layer 40 with the desired permeability such as between 40 to 350 CFM, one may achieve maximum fabric contact with the paper sheet while utilizing an under layer which provides maximum support for the upper layer. In the preferred embodiment of the invention for this application, the under layer is formed in accordance with FIG. 1. By this combination one achieves maximum surface area for adhesive of the upper layer, maximum sheet contact on the drying equipment and reduced permeability of the unitized fabric.

We claim:

1. An improved multilayer papermakers fabric of the type having an under layer of interconnected synthetic monofilament yarns and an upper layer, said under layer and upper layer being retained in a single fabric by adhesive means, the improvement characterized by:

said under layer being comprised of a plurality of intermeshed synthetic monofilament spiral strips which are retained in that relationship by pintle means to establish a predetermined permeability, and said upper layer having a predetermined permeability different from that of said under layer.

2. The fabric of claim 1, further characterized by:

each of said spiral strips containing a plurality of spirals, each of said spirals having a major axis and a minor axis.

3. The fabric of claim 2, further characterized by:

face portions of at least a first surface of said spirals having a width greater than the diameter of the monofilament comprising the spiral strips.

4. The fabric of claim 3, further characterized by:

said face portions having a width no greater than twice the diameter of the monofilament.

5. The fabric of claim 3, further characterized by:

said face portions having a maximum length defined by the equation maximum length equals the major axis minus twice the diameter of the pintle means plus four times the diameter of the monofilament or $L=M-(2p+4d)$.

6. The fabric of claim 3, further characterized by:

second face portions on a second surface of said spirals having a width greater than a diameter of the monofilament comprising the spiral strips.

7. The fabric of claim 6, further characterized by:

said second face portions having a width no greater than twice the diameter of the monofilament.

8. The fabric of claim 7, further characterized by:

said second face portions having a maximum length defined by the equation maximum length equals the major axis minus twice the diameter of the pintle means plus four times the diameter of the monofilament or $L=M-(2p+4d)$.

9. The fabric of claim 7, further characterized by:

said first and second face portions having a maximum length defined by the equation maximum length equals the major axis minus twice the diameter of the pintle means plus four times the diameter of the monofilament or $L=M-(2p+4d)$.

10. The fabric of claim 1 wherein said upper layer is further characterized by:

having a percent open area which is in the range of 10 to 48 percent of the total fabric area.

11. The fabric of claim 10, further characterized by:

each of said spiral strips containing a plurality of spirals, each of said spirals having a major axis and a minor axis.

12. The fabric of claim 11, further characterized by:

face portions of at least a first surface of said spirals having a width greater than the diameter of the monofilament comprising the spiral strips.

13. The fabric of claim 12, further characterized by:

said face portions having a width no greater than twice the diameter of the monofilament.

14. The fabric of claim 12, further characterized by:

said face portions having a maximum length defined by the equation maximum length equals the major axis minus twice the diameter of the pintle means plus four times the diameter of the monofilament or $L=M-(2p+4d)$.

15. The fabric of claim 12, further characterized by:

second face portions on a second surface of said spirals having a width greater than a diameter of the monofilament comprising the spiral strips.

16. The fabric of claim 15, further characterized by:

said second face portions having a width no greater than twice the diameter of the monofilament.

17. The fabric of claim 16, further characterized by:

said second face portions having a maximum length defined by the equation maximum length equals the major axis minus twice the diameter of the pintle means plus four times the diameter of the monofilament or $L=M-(2p+4d)$.

18. The fabric of claim 16, further characterized by:

said first and second face portions having a maximum length defined by the equation maximum length equals the major axis minus twice the diameter of the pintel means plus four times the diameter of the monofilament or $L=M-(2p+4d)$.

19. The fabric of claim 10, wherein said under layer is further characterized by:

having a permeability which is less than 1000 CFM.

20. The fabric of claim 1 wherein said under layer is further characterized by:

having a permeability less than said upper layer and a percent open area which is in the range of 18 to 35 percent of the total fabric area.

21. The fabric of claim 1 wherein said upper layer is further characterized by:

said upper layer being a non-woven layer.

22. An improved multilayer papermakers fabric of the type having an under layer of interconnected synthetic monofilament yarns and an upper layer, said under layer and upper layer being retained in a single fabric by adhesive means, the improvement characterized by:

said under layer being comprised of a plurality of intermeshed synthetic monofilament spiral strips which are retained in that relationship by pintle means.

* * * * *

UNITED STATES PATENT OFFICE

CERTIFICATE OF CORRECTION

Patent No. 4,579,771 Dated April 1, 1986

Inventor(s) William A. Finn and Harry I. Searfass

It is certified that error appears in the above-identified patent and that said Letters Patent are hereby corrected as shown below:

Column 5, line 45, after the word in "th" should read --the--.

Column 6, line 5, after the word permeabilities insert --are--.

Column 6, line 52, "sheat" should read --sheet--.

Column 7, line 22, "strenght" should read --strength--.

Signed and Sealed this

*Twenty-second* Day of *July 1986*

[SEAL]

*Attest:*

DONALD J. QUIGG

*Attesting Officer*

*Commissioner of Patents and Trademarks*